US011117407B2

(12) United States Patent
Wong et al.

(10) Patent No.: US 11,117,407 B2
(45) Date of Patent: Sep. 14, 2021

(54) METHOD AND APPARATUS FOR PRINTING

(71) Applicant: Datamax-O'Neil Corporation, Altamonte Springs, FL (US)

(72) Inventors: Chin Young Wong, Singapore (SG); Yaw Horng Yap, Singapore (SG); Ching Hong Chua, Singapore (SG)

(73) Assignee: Datamax-O'Neil Corporation, Altamonte Springs, FL (US)

( * ) Notice: Subject to any disclaimer, the term of this patent is extended or adjusted under 35 U.S.C. 154(b) by 0 days.

(21) Appl. No.: 16/942,347

(22) Filed: Jul. 29, 2020

(65) Prior Publication Data

US 2020/0353763 A1 Nov. 12, 2020

Related U.S. Application Data

(63) Continuation of application No. 15/854,875, filed on Dec. 27, 2017, now Pat. No. 10,773,537.

(51) Int. Cl.
*B41J 35/28* (2006.01)
*B41J 32/00* (2006.01)
(Continued)

(52) U.S. Cl.
CPC ..... *B41J 35/28* (2013.01); *B41J 3/36* (2013.01); *B41J 29/02* (2013.01); *B41J 32/00* (2013.01); *B41J 33/14* (2013.01); *B41J 35/00* (2013.01)

(58) Field of Classification Search
CPC ... B41J 35/28; B41J 35/00; B41J 33/14; B41J 32/00; B41J 3/36; B41J 29/02
See application file for complete search history.

(56) References Cited

U.S. PATENT DOCUMENTS 4,915,027 A * 4/1990 Ishibashi ..... B41J 3/36 101/486
4,999,016 A * 3/1991 Suzuki ..... B41J 3/36 346/139 R
(Continued)

FOREIGN PATENT DOCUMENTS

WO 2013/163789 A1 11/2013

OTHER PUBLICATIONS

Matt Hussey, "Pocket-sized printer creates documents by rolling across pages," dated Apr. 14, 2014; 4 pages.
(Continued)

*Primary Examiner* — Justin Seo
(74) *Attorney, Agent, or Firm* — Alston & Bird LLP

(57) ABSTRACT

The present invention embraces printers such as hand-held printers and mobile/portable printer. One exemplary embodiment includes "print as you glide" (PAYG) devices. Such printers may comprise a modular print engine that is removable from the printer and may allow a user to easily access and load the ribbon in the mobile print engine. The modular print engine may comprise a modular print head and an encoder that may determine the movement of the print head relative to a stationary media. When a printer is pressed against the media, the print head's burn line may be resting on the media. When the printer is stationary relative to the media, the encoder may not trigger the printing. Once PAYG is being slid or glided across the media, the encoder may start to rotate and then send a signal to a processor, causing the printer to start printing.

20 Claims, 17 Drawing Sheets

(51) Int. Cl.

| | |
|---|---|
| ***B41J 3/36*** | (2006.01) |
| ***B41J 29/02*** | (2006.01) |
| ***B41J 33/14*** | (2006.01) |
| ***B41J 35/00*** | (2006.01) |

(56) References Cited

U.S. PATENT DOCUMENTS 5,024,541 A * 6/1991 Tsukada ..... B41J 3/36 400/693
6,832,725 B2 12/2004 Gardiner et al.
7,128,266 B2 10/2006 Zhu et al.
7,159,783 B2 1/2007 Walczyk et al.
7,413,127 B2 8/2008 Ehrhart et al.
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Horn et al.
8,381,979 B2 2/2013 Franz
8,390,909 B2 3/2013 Plesko
8,408,464 B2 4/2013 Zhu et al.
8,408,468 B2 4/2013 Van et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van et al.
8,556,177 B2 10/2013 Hussey et al.
8,559,767 B2 10/2013 Barber et al.
8,561,895 B2 10/2013 Gomez et al.
8,561,903 B2 10/2013 Sauerwein, Jr.
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre, Jr.
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz, Sr.
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue et al.
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein, Jr.
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.

(56) References Cited

U.S. PATENT DOCUMENTS

| | | | |
|---|---|---|---|
| 8,914,788 | B2 | 12/2014 | Pettinelli et al. |
| 8,915,439 | B2 | 12/2014 | Feng et al. |
| 8,915,444 | B2 | 12/2014 | Havens et al. |
| 8,916,789 | B2 | 12/2014 | Woodburn |
| 8,918,250 | B2 | 12/2014 | Hollifield |
| 8,918,564 | B2 | 12/2014 | Caballero |
| 8,925,818 | B2 | 1/2015 | Kosecki et al. |
| 8,939,374 | B2 | 1/2015 | Jovanovski et al. |
| 8,942,480 | B2 | 1/2015 | Ellis |
| 8,944,313 | B2 | 2/2015 | Williams et al. |
| 8,944,327 | B2 | 2/2015 | Meier et al. |
| 8,944,332 | B2 | 2/2015 | Harding et al. |
| 8,950,678 | B2 | 2/2015 | Germaine et al. |
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | El et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber et al. |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,082,031 | B2 | 7/2015 | Liu et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| D737,321 | S | 8/2015 | Lee |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham, IV |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein, Jr. |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Smith |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| D754,205 | S | 4/2016 | Nguyen et al. |
| D754,206 | S | 4/2016 | Nguyen et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| 9,319,548 | B2 | 4/2016 | Showering et al. |
| D757,009 | S | 5/2016 | Oberpriller et al. |
| 9,342,723 | B2 | 5/2016 | Liu et al. |
| 9,342,724 | B2 | 5/2016 | McCloskey et al. |
| 9,360,304 | B2 | 6/2016 | Xue et al. |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,383,848 | B2 | 7/2016 | Daghigh |
| 9,384,374 | B2 | 7/2016 | Bianconi |
| 9,390,304 | B2 | 7/2016 | Chang et al. |
| 9,390,596 | B1 | 7/2016 | Todeschini |
| D762,604 | S | 8/2016 | Fitch et al. |
| 9,411,386 | B2 | 8/2016 | Sauerwein, Jr. |
| 9,412,242 | B2 | 8/2016 | Van et al. |
| 9,418,269 | B2 | 8/2016 | Havens et al. |

(56) References Cited

U.S. PATENT DOCUMENTS 9,418,270 B2 8/2016 Van et al.
9,423,318 B2 8/2016 Liu et al.
9,424,454 B2 8/2016 Tao et al.
D766,244 S 9/2016 Zhou et al.
9,436,860 B2 9/2016 Smith et al.
9,443,123 B2 9/2016 Hejl
9,443,222 B2 9/2016 Singel et al.
9,454,689 B2 9/2016 McCloskey et al.
9,464,885 B2 10/2016 Lloyd et al.
9,465,967 B2 10/2016 Xian et al.
9,478,113 B2 10/2016 Xie et al.
9,478,983 B2 10/2016 Kather et al.
D771,631 S 11/2016 Fitch et al.
9,481,186 B2 11/2016 Bouverie et al.
9,487,113 B2 11/2016 Schukalski
9,488,986 B1 11/2016 Solanki
9,489,782 B2 11/2016 Payne et al.
9,490,540 B1 11/2016 Davies et al.
9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0063048 A1 3/2007 Havens et al.
2008/0185432 A1 8/2008 Caballero et al.
2009/0032560 A1 2/2009 Strandberg et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2010/0265880 A1 10/2010 Rautiola et al.
2011/0025804 A1 2/2011 Rosati et al.
2011/0169999 A1 7/2011 Grunow et al.
2011/0202554 A1 8/2011 Powilleit et al.
2012/0111946 A1 5/2012 Golant
2012/0168511 A1 7/2012 Kotlarsky et al.
2012/0168512 A1 7/2012 Kotlarsky et al.
2012/0193423 A1 8/2012 Samek
2012/0194692 A1 8/2012 Mers et al.
2012/0203647 A1 8/2012 Smith
2012/0223141 A1 9/2012 Good et al.
2012/0228382 A1 9/2012 Havens et al.
2012/0248188 A1 10/2012 Kearney
2013/0033556 A1 2/2013 Bouverie et al.
2013/0043312 A1 2/2013 Van Horn
2013/0075168 A1 3/2013 Amundsen et al.
2013/0082104 A1 4/2013 Kearney et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedrao
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2013/0332996 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0034734 A1 2/2014 Sauerwein, Jr.
2014/0036848 A1 2/2014 Pease et al.
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0097249 A1 4/2014 Gomez et al.
2014/0098792 A1 4/2014 Wang et al.
2014/0100774 A1 4/2014 Showering
2014/0100813 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein, Jr.
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0191684 A1 7/2014 Valois
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 Digregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0332590 A1 11/2014 Wang et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.

(56) References Cited

U.S. PATENT DOCUMENTS

2014/0374483 A1 12/2014 Lu
2014/0374485 A1 12/2014 Xian et al.
2015/0001301 A1 1/2015 Ouyang
2015/0001304 A1 1/2015 Todeschini
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0039878 A1 2/2015 Barten
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0178523 A1 6/2015 Gelay et al.
2015/0178537 A1 6/2015 El et al.
2015/0178685 A1 6/2015 Krumel et al.
2015/0181109 A1 6/2015 Gillet et al.
2015/0186703 A1 7/2015 Chen et al.
2015/0199957 A1 7/2015 Funyak et al.
2015/0210199 A1 7/2015 Payne
2015/0212565 A1 7/2015 Murawski et al.
2015/0213647 A1 7/2015 Laffargue et al.
2015/0220753 A1 8/2015 Zhu et al.
2015/0220901 A1 8/2015 Gomez et al.
2015/0227189 A1 8/2015 Davis et al.
2015/0236984 A1 8/2015 Sevier
2015/0239348 A1 8/2015 Chamberlin
2015/0242658 A1 8/2015 Nahill et al.
2015/0248572 A1 9/2015 Soule et al.
2015/0254485 A1 9/2015 Feng et al.
2015/0261643 A1 9/2015 Caballero et al.
2015/0264624 A1 9/2015 Wang et al.
2015/0268971 A1 9/2015 Barten
2015/0269402 A1 9/2015 Barber et al.
2015/0288689 A1 10/2015 Todeschini et al.
2015/0288896 A1 10/2015 Wang
2015/0310243 A1 10/2015 Ackley et al.
2015/0310244 A1 10/2015 Xian et al.
2015/0310389 A1 10/2015 Crimm et al.
2015/0312780 A1 10/2015 Wang et al.
2015/0327012 A1 11/2015 Bian et al.
2016/0014251 A1 1/2016 Hejl
2016/0025697 A1 1/2016 Alt et al.
2016/0026838 A1 1/2016 Gillet et al.
2016/0026839 A1 1/2016 Qu et al.
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0070944 A1 3/2016 McCloskey et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue et al.
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0125873 A1 5/2016 Braho et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Franz
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini et al.
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 Dipiazza et al.
2016/0192051 A1 6/2016 Dipiazza et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggerty et al.
2016/0204636 A1 7/2016 Allen et al.
2016/0204638 A1 7/2016 Miraglia et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Wilz et al.
2016/0314294 A1 10/2016 Kubler et al.
2016/0316190 A1 10/2016 McCloskey et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley

(56) References Cited

U.S. PATENT DOCUMENTS

| | | | |
|---|---|---|---|
| 2016/0364914 | A1 | 12/2016 | Todeschini |
| 2016/0370220 | A1 | 12/2016 | Ackley et al. |
| 2016/0372282 | A1 | 12/2016 | Bandringa |
| 2016/0373847 | A1 | 12/2016 | Vargo et al. |
| 2016/0377414 | A1 | 12/2016 | Thuries et al. |
| 2016/0377417 | A1 | 12/2016 | Jovanovski et al. |
| 2017/0010141 | A1 | 1/2017 | Ackley |
| 2017/0010328 | A1 | 1/2017 | Mullen et al. |
| 2017/0010780 | A1 | 1/2017 | Waldron et al. |
| 2017/0016714 | A1 | 1/2017 | Laffargue et al. |
| 2017/0018094 | A1 | 1/2017 | Todeschini |
| 2017/0046603 | A1 | 2/2017 | Lee et al. |
| 2017/0047864 | A1 | 2/2017 | Stang et al. |
| 2017/0053146 | A1 | 2/2017 | Liu et al. |
| 2017/0053147 | A1 | 2/2017 | Germaine et al. |
| 2017/0053647 | A1 | 2/2017 | Nichols et al. |
| 2017/0055606 | A1 | 3/2017 | Xu et al. |
| 2017/0060316 | A1 | 3/2017 | Larson |
| 2017/0061961 | A1 | 3/2017 | Nichols et al. |
| 2017/0064634 | A1 | 3/2017 | Van et al. |
| 2017/0083730 | A1 | 3/2017 | Feng et al. |
| 2017/0091502 | A1 | 3/2017 | Furlong et al. |
| 2017/0091706 | A1 | 3/2017 | Lloyd et al. |
| 2017/0091741 | A1 | 3/2017 | Todeschini |
| 2017/0091904 | A1 | 3/2017 | Ventress, Jr. |
| 2017/0092908 | A1 | 3/2017 | Chaney |
| 2017/0094238 | A1 | 3/2017 | Germaine et al. |
| 2017/0098947 | A1 | 4/2017 | Wolski |
| 2017/0100949 | A1 | 4/2017 | Celinder et al. |
| 2017/0108838 | A1 | 4/2017 | Todeschini et al. |
| 2017/0108895 | A1 | 4/2017 | Chamberlin et al. |
| 2017/0118355 | A1 | 4/2017 | Wong et al. |
| 2017/0123598 | A1 | 5/2017 | Phan et al. |
| 2017/0124369 | A1 | 5/2017 | Rueblinger et al. |
| 2017/0124396 | A1 | 5/2017 | Todeschini et al. |
| 2017/0124687 | A1 | 5/2017 | McCloskey et al. |
| 2017/0126873 | A1 | 5/2017 | McGary et al. |
| 2017/0126904 | A1 | 5/2017 | D'Armancourt et al. |
| 2017/0139012 | A1 | 5/2017 | Smith |
| 2017/0140329 | A1 | 5/2017 | Bernhardt et al. |
| 2017/0140731 | A1 | 5/2017 | Smith |
| 2017/0147847 | A1 | 5/2017 | Berggren et al. |
| 2017/0150124 | A1 | 5/2017 | Thuries |
| 2017/0169198 | A1 | 6/2017 | Nichols |
| 2017/0171035 | A1 | 6/2017 | Lu et al. |
| 2017/0171703 | A1 | 6/2017 | Maheswaranathan |
| 2017/0171803 | A1 | 6/2017 | Maheswaranathan |
| 2017/0180359 | A1 | 6/2017 | Wolski et al. |
| 2017/0180577 | A1 | 6/2017 | Nguon et al. |
| 2017/0181299 | A1 | 6/2017 | Shi et al. |
| 2017/0190192 | A1 | 7/2017 | Delario et al. |
| 2017/0193432 | A1 | 7/2017 | Bernhardt |
| 2017/0193461 | A1 | 7/2017 | Celinder et al. |
| 2017/0193727 | A1 | 7/2017 | Van et al. |
| 2017/0199266 | A1 | 7/2017 | Rice et al. |
| 2017/0200108 | A1 | 7/2017 | Au et al. |
| 2017/0200275 | A1 | 7/2017 | McCloskey et al. |
| 2019/0193443 | A1 | 6/2019 | Wong et al. |

OTHER PUBLICATIONS

Non-Final Rejection dated Oct. 28, 2019 for U.S. Appl. No. 15/854,875.

Notice of Allowance and Fees Due (PTOL-85) dated Jan. 29, 2020 for U.S. Appl. No. 15/854,875.

Notice of Allowance and Fees Due (PTOL-85) dated May 26, 2020 for U.S. Appl. No. 15/854,875.

Requirement for Restriction/Election dated Mar. 29, 2019 for U.S. Appl. No. 15/854,875.

Virendra Mehra, "Copy & Paste: A Portable Scanning and Printing Tool," dated Sep. 28, 2014;5 pages.

U.S. Appl. No. 15/854,875, filed Dec. 27, 2017, 2019-0193443 A1, Published.

* cited by examiner

METHOD AND APPARATUS FOR PRINTING

CROSS-REFERENCE TO RELATED APPLICATIONS

This application is a continuation of U.S. application Ser. No. 15/854,875, filed Dec. 27, 2017, the entire contents of which are incorporated herein by reference.

FIELD OF THE INVENTION

The present invention relates to improvements in printers, and more particularly, for apparatus and methods for a hand-held printer.

BACKGROUND

Generally speaking, a legacy printer is a stationary device comprising a printer mechanism. Instructions and content are input to the legacy printer causing the legacy printer to print the content on media, such as a label. This legacy printer design lacks flexibility, especially when a mobile printer environment is desired.

Therefore, a need exists for apparatuses and methods for portable or mobile printer architectures and mechanisms.

SUMMARY

Accordingly, in one aspect, the present invention embraces printers such as hand-held printers and mobile/portable printers. One exemplary embodiment includes "print as you glide" (PAYG) devices. Such printers may comprise a modular print engine that is removable from the printer and may allow a user to easily access and load the ribbon in the mobile print engine.

In an exemplary embodiment, a device comprises: a modular print engine comprising a modular print head and a media encoder; a printed circuit board (PCB) comprising a processor; and a main body comprising the modular print engine and the printed circuit board. The modular print engine is removable from the main body to allow a user to load a new ribbon in the modular print engine. When the modular print engine and a media are in contact and there is movement between the modular print engine and the media, the modular print engine prints on the media.

When the device presses against the media, a burn line of the modular print head presses a ribbon against the media. In response to the device starting to slide across to the media, the media encoder sends a signal to the processor with an instruction to start a print operation. The media encoder generates the signal based on a rotation in the media encoder caused by the device sliding across the media. The modular print engine comprises a rotating arm with a spring mechanism, associated with the media encoder. Based on a direction of rotation of the media encoder, the modular print engine either stops printing, or continues printing. The main body comprises a battery. The modular print head is removable from the modular print engine. The device comprises a fine needle opening located at one end of the device, wherein, when an adapter plug is inserted in the fine needle opening, silicon rubber of the adapter plug conforms to a shape of the adapter plug and creates a seamless water proofing seal between the adapter plug and the device.

In another exemplary embodiment, a method comprising the steps of: opening, by a user, a cover from a main body of a printer; removing, by the user, a modular print engine from a casing of the main body; loading, by the user, a ribbon roll in the modular print engine; inserting, by the user, the modular print engine in the casing of the main body; and closing, by the user, the cover on the main body. Loading the ribbon roll in the modular print engine comprises installing a new ribbon on a ribbon supply shaft, and removing an old ribbon from a ribbon rewind shaft. A media encoder determines if the modular print engine is depleted of ribbon.

In yet another exemplary embodiment, a method comprise the steps of: removing, by a user, a modular print engine from a main body of a printer; loading, by the user, a ribbon roll into the modular print engine; re-installing, by the user, the modular print engine in the main body of the printer positioning and pressing, by the user, a print head and a media encoder of the modular print engine on a media located on a horizontal surface; and sliding, by the user, the print head across the media causing the media encoder to sense a movement of the media relative to the print head and send a signal to a processor of the printer. The processor sends an instruction to the print head to begin a print operation.

If the user continues to slide the print head across the media, the print head continues the print operation. If the user does not continue to slide the print head across the media, the processor sends another instruction to the print head to stop the print operation. Removing the modular print engine from the main body of the printer comprises the user removing a cover from the modular print engine and removing the modular print engine from a casing of the main body of the printer. When the print head presses against the media, a burn line of the print head presses ribbon against the media. The media encoder pulls ribbon pass a burn line as the printer slides across the media. The print head is removable from the modular print engine.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

FIG. 2I illustrates an exemplary embodiment of modular print engine assembly including ribbon rewind shaft comprising gear teeth at one end of the ribbon rewind shaft.

DETAILED DESCRIPTION

The present invention embraces printers such as mobile, portable or hand-held printers. One exemplary embodiment includes "print as you glide" (PAYG) devices. A printer based on the present invention may comprise a modular print engine that is removable from the printer and may allow a user to easily access and load the ribbon in the modular print engine. The modular print engine may comprise a modular print head and a media encoder that may determine the movement of the print head relative to a stationary media. When a printer is pressed against the media, the print head's burn line may be resting on the media. When the printer is stationary relative to the media, the media encoder may not trigger the printing. Once a PAYG device begins to slide or glide across the media, the media encoder may start to rotate and then may send a signal to a processor, causing the printer to start printing. One skilled in the art may recognize that the terms "stationary media" means that the media, e.g., a label, is stationary relative to the modular print engine. In another embodiment, the modular print engine may be stationary, and the media moves relative to the modular print engine. For either embodiment, the print operation may start when there is relative movement between the modular print engine and the media.

The modular print engine may include a ribbon encoder that may determine if the modular print engine is depleted of ribbon. The modular print head may removable from the modular print engine.

To support battery charging or direct powering of the printer, a very fine needle opening is present on the main body of the printer for an adapter plug. Upon insertion of the adapter plug, the silicon rubber, with its stretchable ability, conforms the shape of the adapter plug and creates a seamless water proofing seal between the adapter plug and the printer. Effectively, the silicon rubber is part of the housing of the printer. When the adapter plug is inserted into the housing, the silicon rubber may stretch itself to confirm to the shape of the mating part.

Figure 1A:
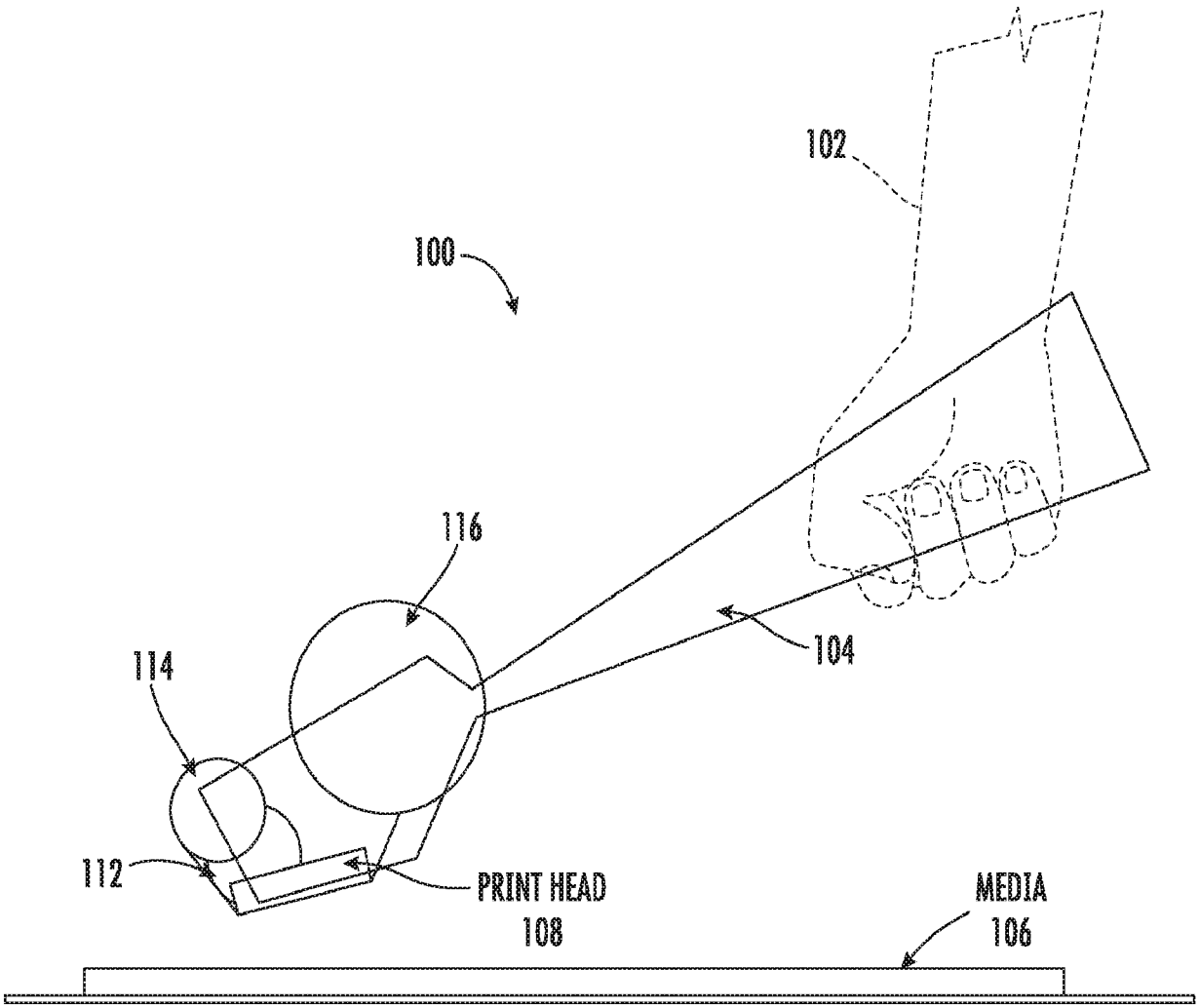
FIG. 1A provides a cross-sectional view of an exemplary embodiment of the components of a printer.

FIG. 1A provides a cross-sectional view of an exemplary embodiment of the components of printer 100. Printer 100 may be a PAYG device. As shown, handle 104 of printer 100 may be configured to provide a removable engagement with user 102. In one embodiment, the user 102 may pick-up handle 104 and hold printer 100 in their hand, per FIG. 1A.

Printer 100 may further comprise ribbon supply shaft 116 and ribbon rewind shaft 114. The ribbon supply shaft 116 may comprise a roll of ribbon such as a new ribbon, and the ribbon rewind shaft 114 may include old or used ribbon. Printing may be facilitated with print head 108 and media encoder 112. Print head 108 may be a near edge print head. Located on a horizontal surface may be the media 106. As illustrated in FIG. 1A, media 106 may be a pasted label Media encoder 112 may determine the movement of print head 108 relative to media 106.

Figure 1B:
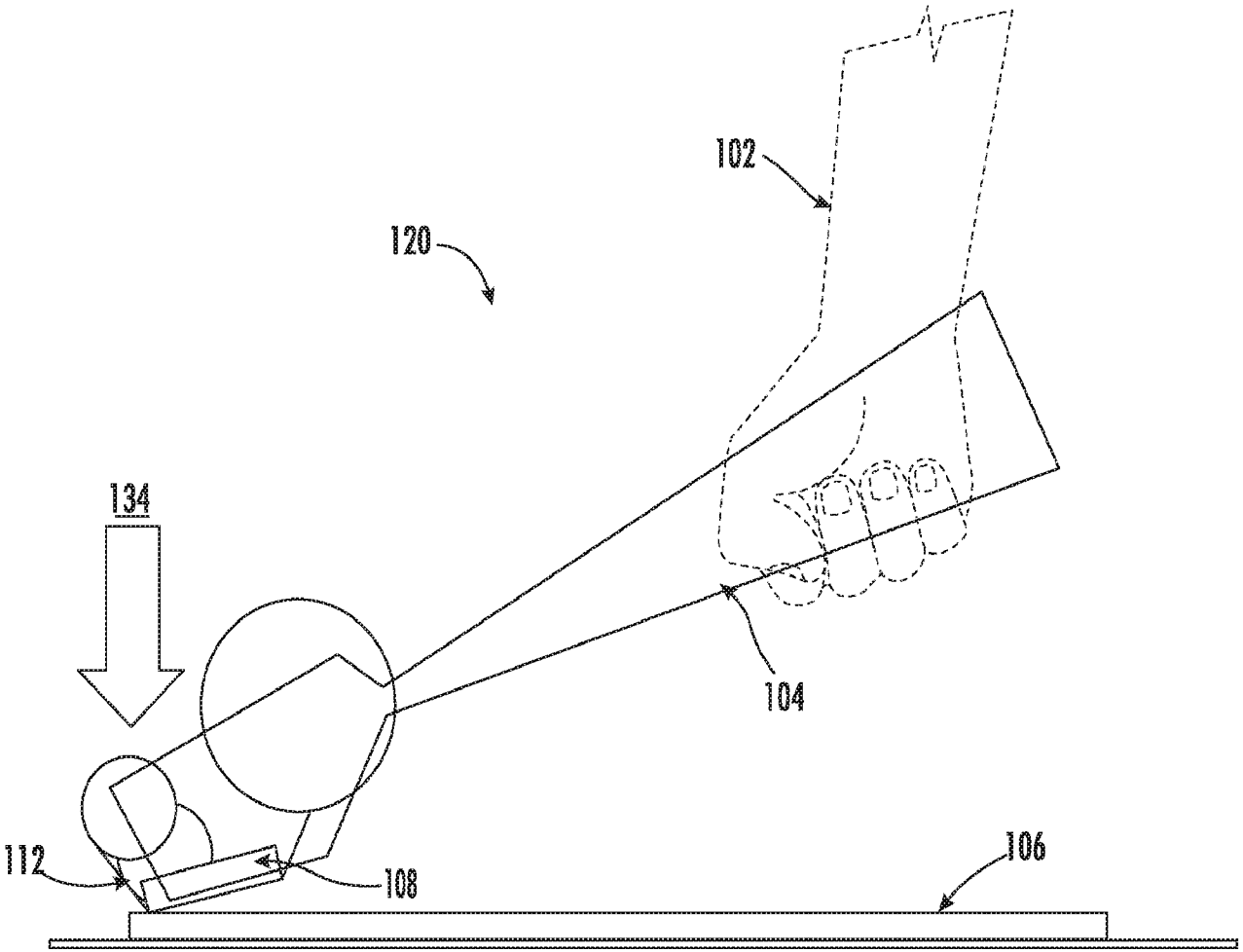
FIG. 1B provides a cross-sectional view of an exemplary embodiment of a portion of the operation of a printer.

FIG. 1B provides a cross-sectional view of an exemplary embodiment of a portion of the operation of printer 120. As shown, user 102 may engage with and hold handle 104 of printer 120. User 102 may proceed to press down the print head 108 and media encoder 112 with force 134. When printer 120 is pressed against media 106, print head 108's burn line is resting on media 106. If printer 120 is stationary, media encoder 112 may not trigger the printing.

Figure 1C:
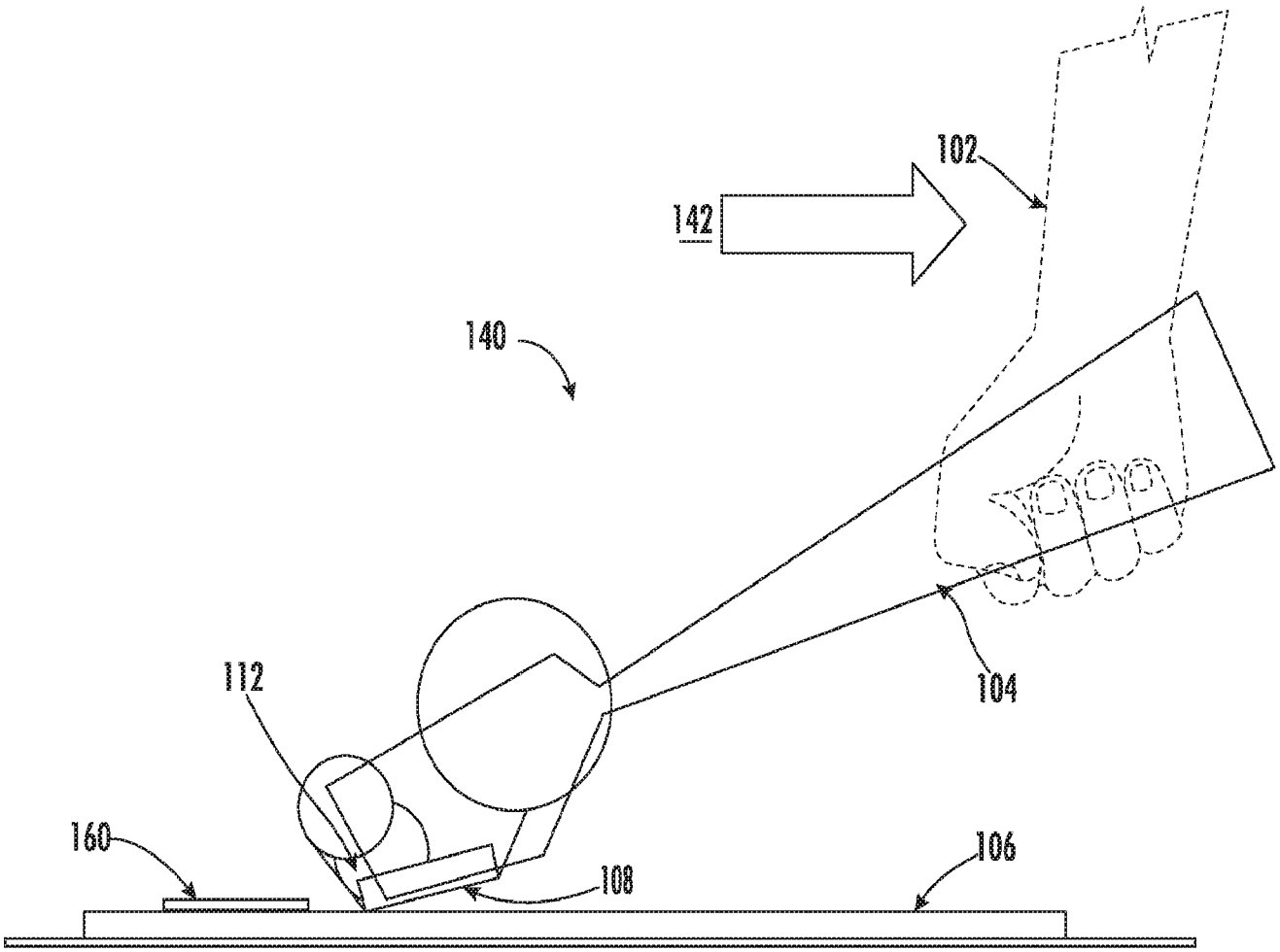
FIG. 1C provides a cross-sectional view of an exemplary embodiment of another portion of the operation of a printer.

FIG. 1C provides a cross-sectional view of an exemplary embodiment of another portion of the operation of a printer 140. As shown, user 102, while engaged with handle 104, may pull printer 140 across media 106 with force 142. Concurrently, media encoder 112 may rotate and may start to fire print head 108. Subsequently, ink 160, wax or other material suitable for thermal transfer may be deposited on media 106. Hence, once printer 140 starts to slide (or glide), media encoder 112 may start to rotate and send a signal to a processor of printer 140, causing a print operation to start. The media encoder 112 pulls in loose ribbon as the printer slides across the media 106. The specifics of this action are described herein in FIGS. 2G, 2H, 2I and 2J.

Figure 2A:
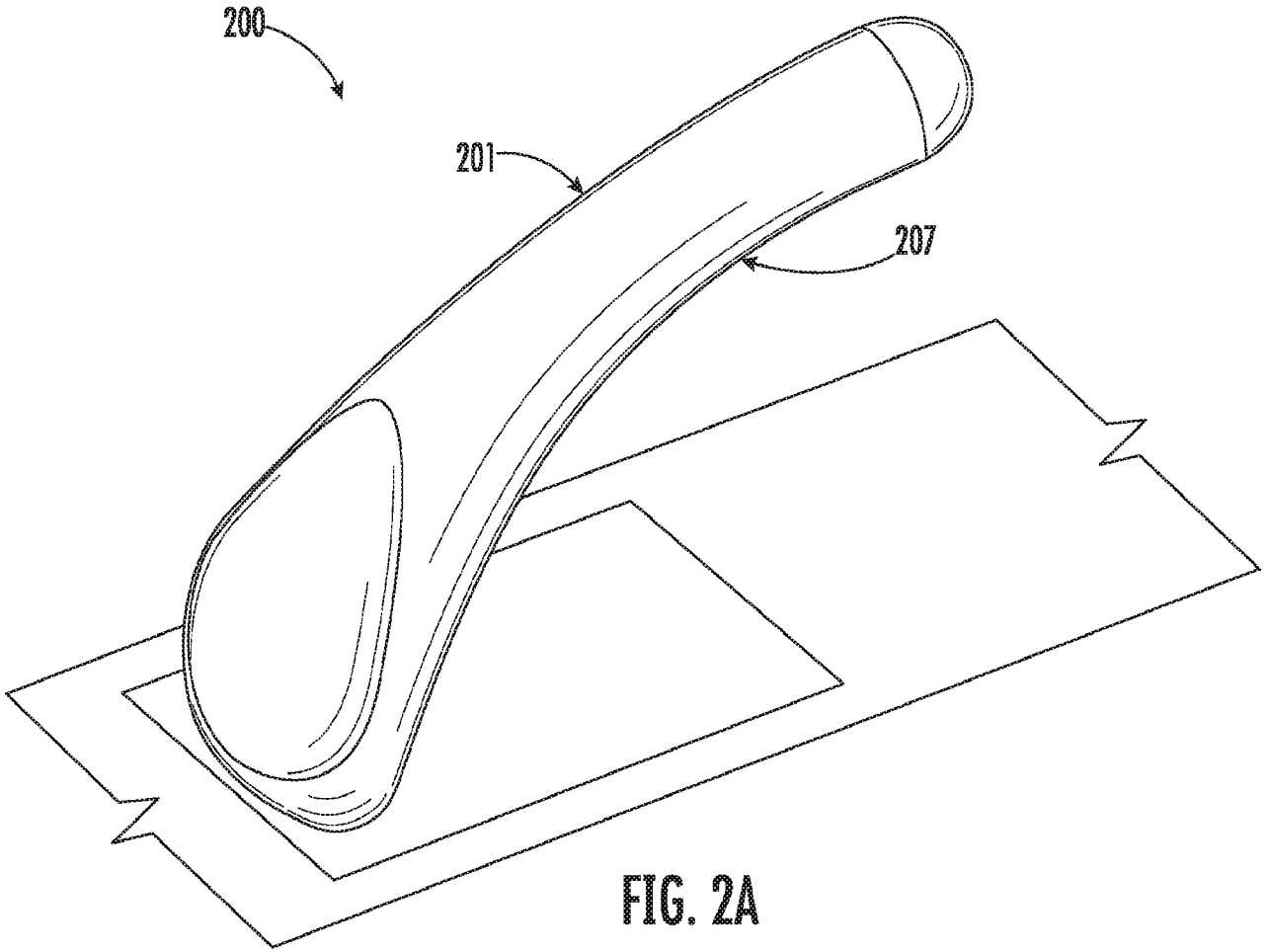
FIG. 2A illustrates an exemplary embodiment of a printer.

FIG. 2A illustrates an exemplary embodiment of printer 200. Printer 200 is shown in a physical position as the PAYG device may be normally used in a print operation. Printer 200 may comprise a main body 201. Main body 201 provides the functionality for handle 104 of FIG. 1A, FIG. 1B, and FIG. 1C. In one embodiment, main body 201 may be designed with a single span surface where the surface is smooth. The main body 201 may also comprise a handle area 207 having a rubber surface. Handle area 207 is located on the bottom portion of main body 201. The rubber surface may comprise a silicon material. The rubber surface may assist in improving the engagement of the grip of user 102 on printer 200.

Figure 2B:
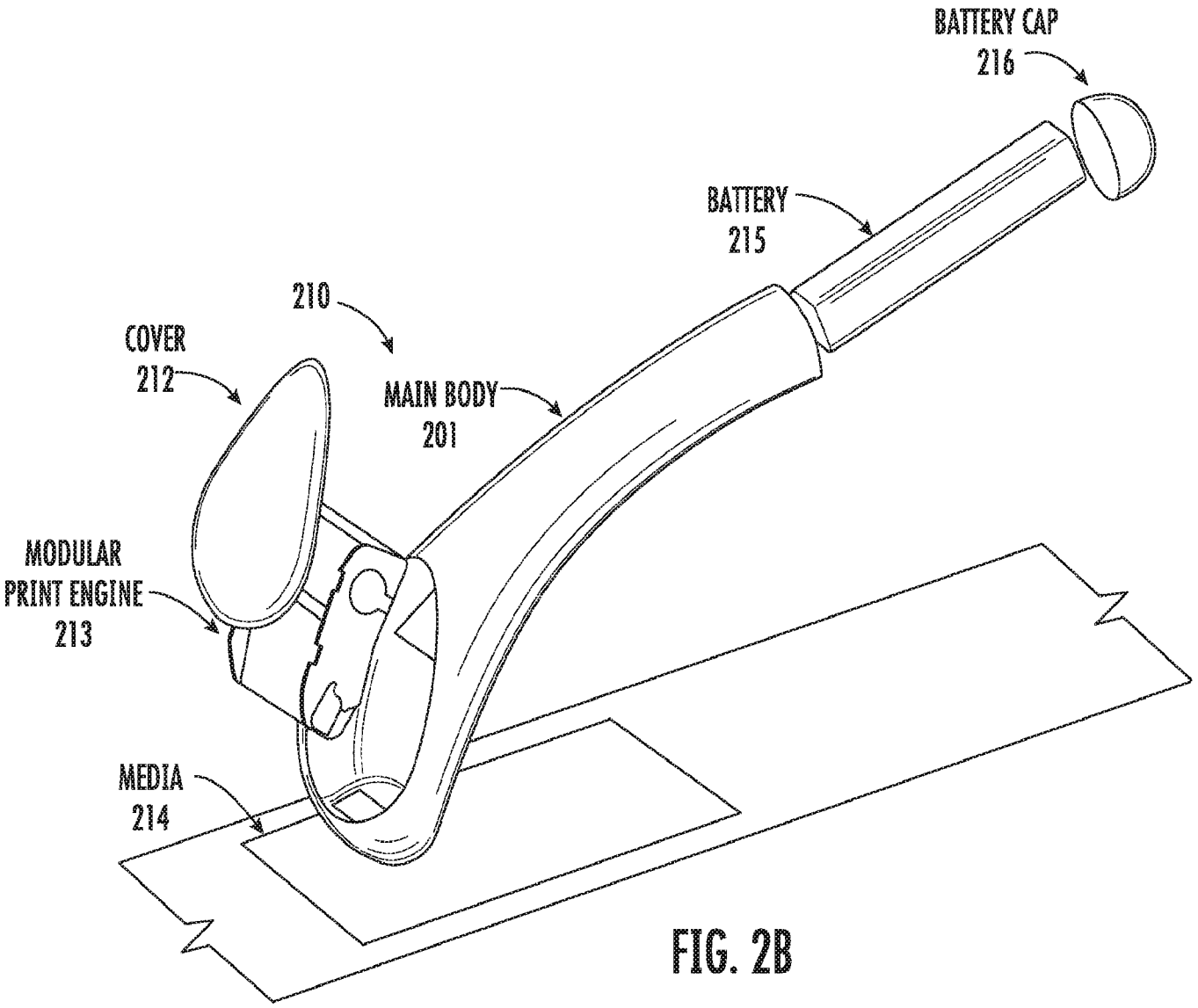
FIG. 2B illustrates an exemplary embodiment of an exploded view of a printer.

FIG. 2B illustrates an exemplary embodiment of an exploded view of a printer 210. Printer 210 may comprise main body 201, cover 212, modular print engine 213, battery 215 and battery cap 216. Printer 210 may be positioned proximate to media 214 that may be positioned on a horizontal surface.

Figure 2C:
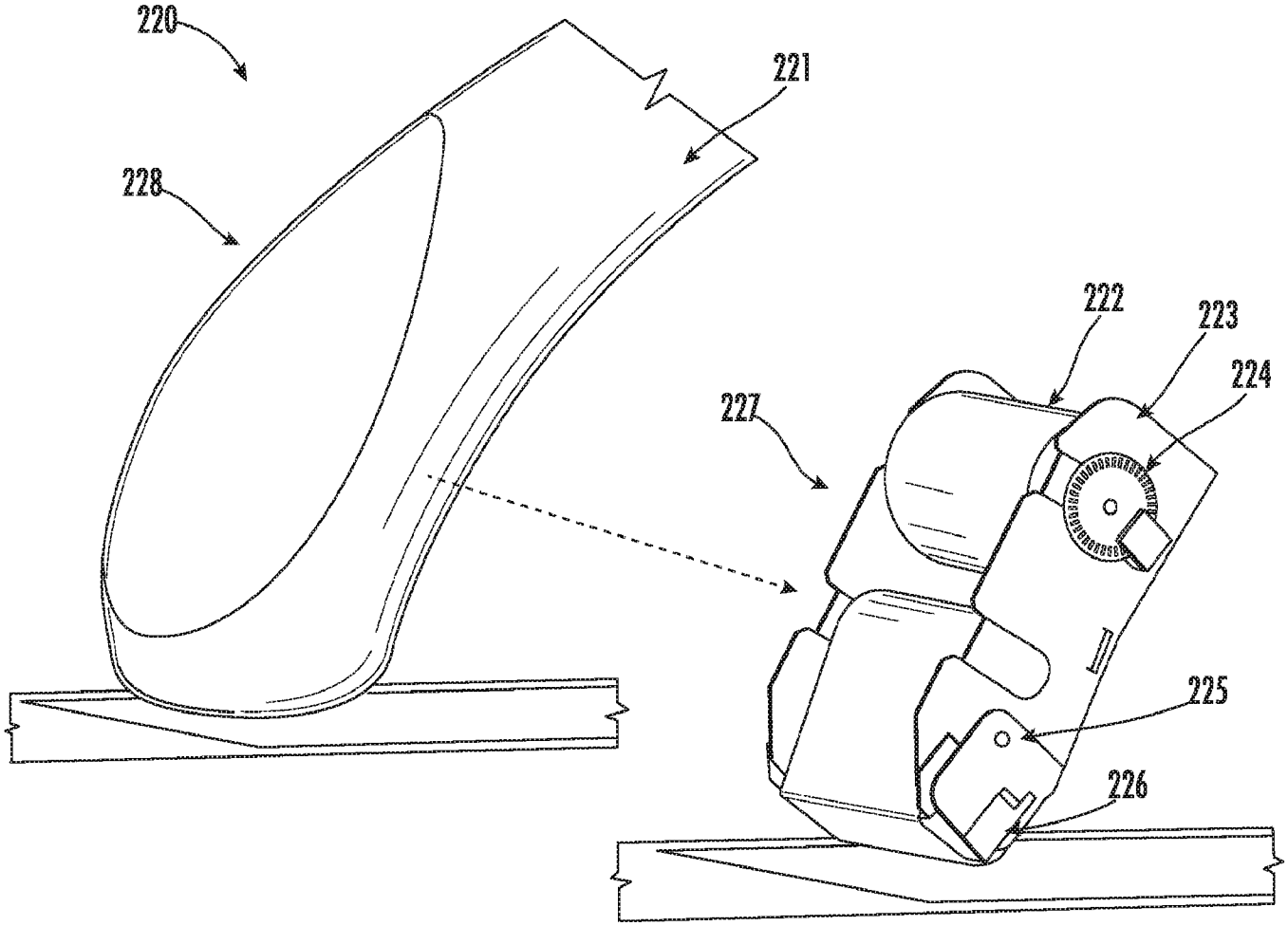
FIG. 2C illustrates an exemplary embodiment of a print engine of a printer and its positioning in the printer.

FIG. 2C illustrates an exemplary embodiment of a modular print engine 227 of printer 220 and is positioning in the main body 228 of printer 220. As shown, modular print engine 227 may be positioned in a lower portion of the main body 228. Located in the upper portion of the main body may be a printed circuit board (PCB) 221 which may contain logic, circuitry, and a processor for printer operation. Modular print engine 227 may comprise ribbon roll 222, engine holder 223, ribbon encoder 224, rotating arm 225, and a modular print head 226. Ribbon encoder 224 may determine if ribbon roll 222 is depleted of ribbon.

Figure 2D:
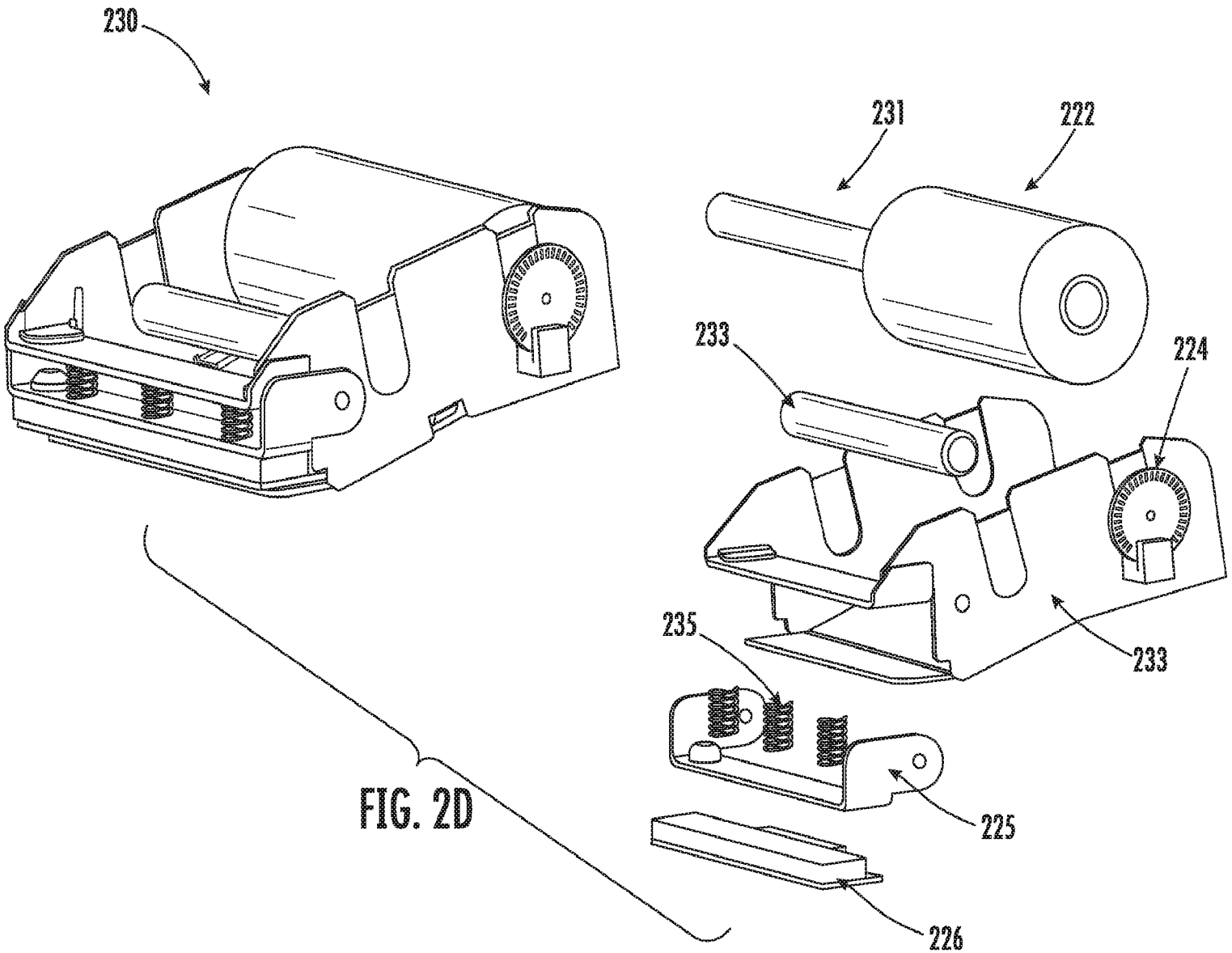
FIG. 2D illustrates an exemplary embodiment of a subsystem of a modular print engine assembly of a printer.

FIG. 2D illustrates an exemplary embodiment of a subsystem of a modular print engine assembly 230 for printer 200. Modular print engine assembly 230 may comprise ribbon supply shaft 231, ribbon roll 222, ribbon rewind shaft 233, engine holder 223, a spring mechanism 235, rotating arm 225, a modular print head 226 and a ribbon encoder 224. Note that FIG. 2C and FIG. 2D have some equivalent elements.

The modular print head 226 may be a replaceable component. Ribbon encoder 224 may determine if the roll of ribbon on ribbon supply shaft 231 is depleted of ribbon. In this case may be appropriate for a new ribbon to be loaded in the modular print engine. The other encoder, equivalent to media encoder 112 of FIG. 1A, may be located on the other side of rotating arm 225, but is not shown on FIG. 2D.

Pressing down on modular print head 226 may cause a swivel of rotating arm 225. When modular print head 226 is slid across media 214, as illustrated in FIG. 2B, the media encoder senses a movement of the media relative to the print head and sends a signal to a processor of the printer. In one exemplary embodiment, a wheel associated with media encoder 112, as illustrated in FIGS. 1A, 1B and 1C, rotates and causes a signal to be generated. The signal, with instructions to begin a print operation, is coupled to a processor of the printer. Rotating arm 225 further comprises spring mechanism 235.

Figure 2E:
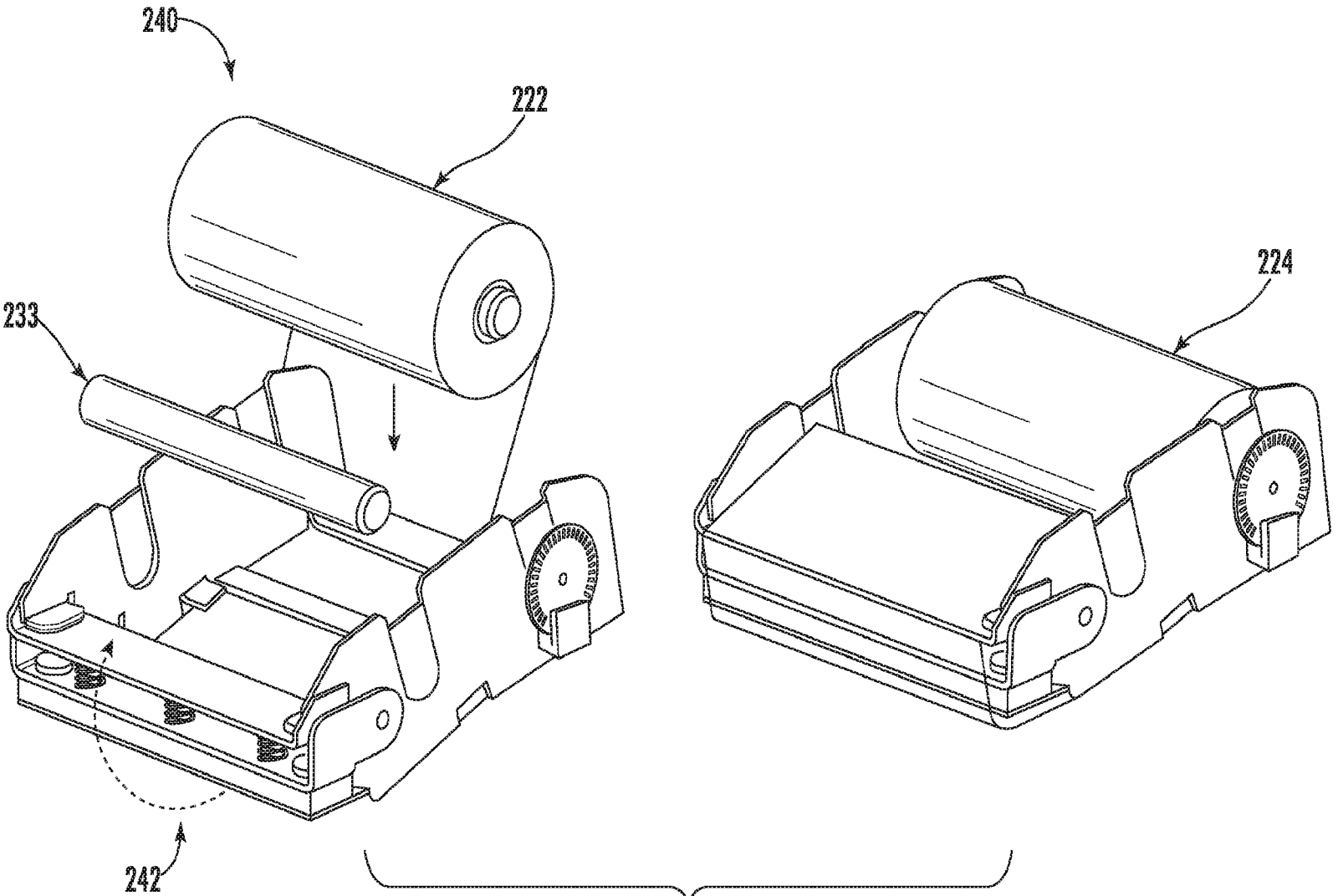
FIG. 2E illustrates an exemplary embodiment the process of loading a ribbon in a printer.

FIG. 2E illustrates an exemplary embodiment the process of loading a ribbon in a modular print engine assembly 240. As shown, ribbon roll 222 may be engaged or installed in the modular print engine assembly 240, as indicated by the downward arrow. Ribbon rewind shaft 233 may be available to support the old or used ribbon. Dotted line 242 indicates the rotation of rotating arm 225. Ribbon may be easily installed in modular print engine assembly 240 to provide an assembled modular print engine 244. In other words, the modular print engine is removed by the user from the main body of the device by (i) removing a cover of the main body, and (ii) picking up the modular print engine from a casing of the main body. With the removal of the modular print engine from the main body, the user loads the new ribbon on a ribbon supply shaft and removes an old ribbon from a ribbon unwind shaft.

Figure 2F:
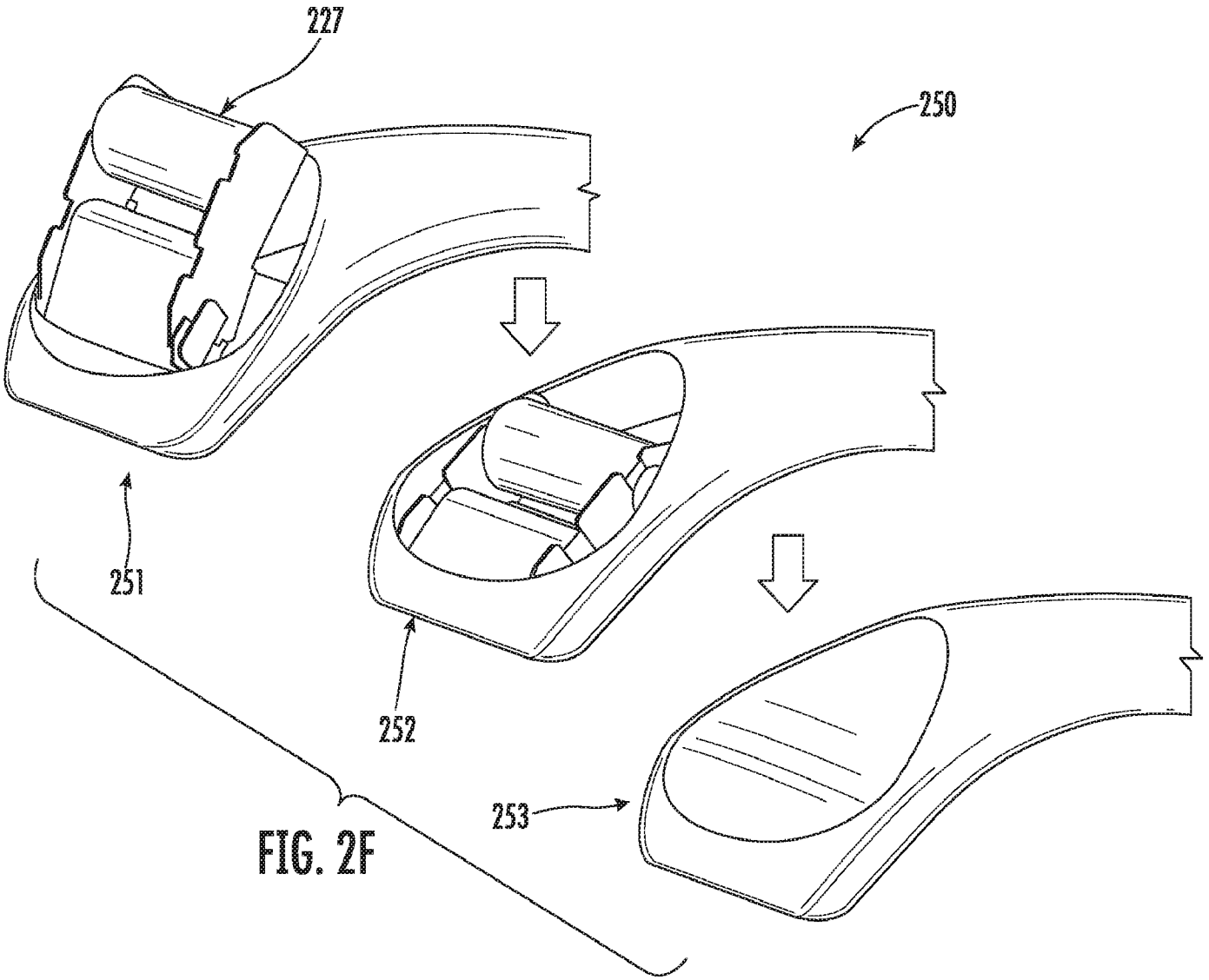
FIG. 2F illustrates an exemplary embodiment of the process of installing a modular print engine into the main body of a printer.

FIG. 2F illustrates an exemplary embodiment of the process 250 of the installing modular print engine 227 into the printer 200. As shown, modular print engine 227 may begin to be inserted in in main body 251. In main body 252, the insertion of modular print engine 227 may be completed. Finally, in main body 253, a cover is placed on main body 253 to protect and secure the modular print engine 227 in printer 200.

Figure 2G:
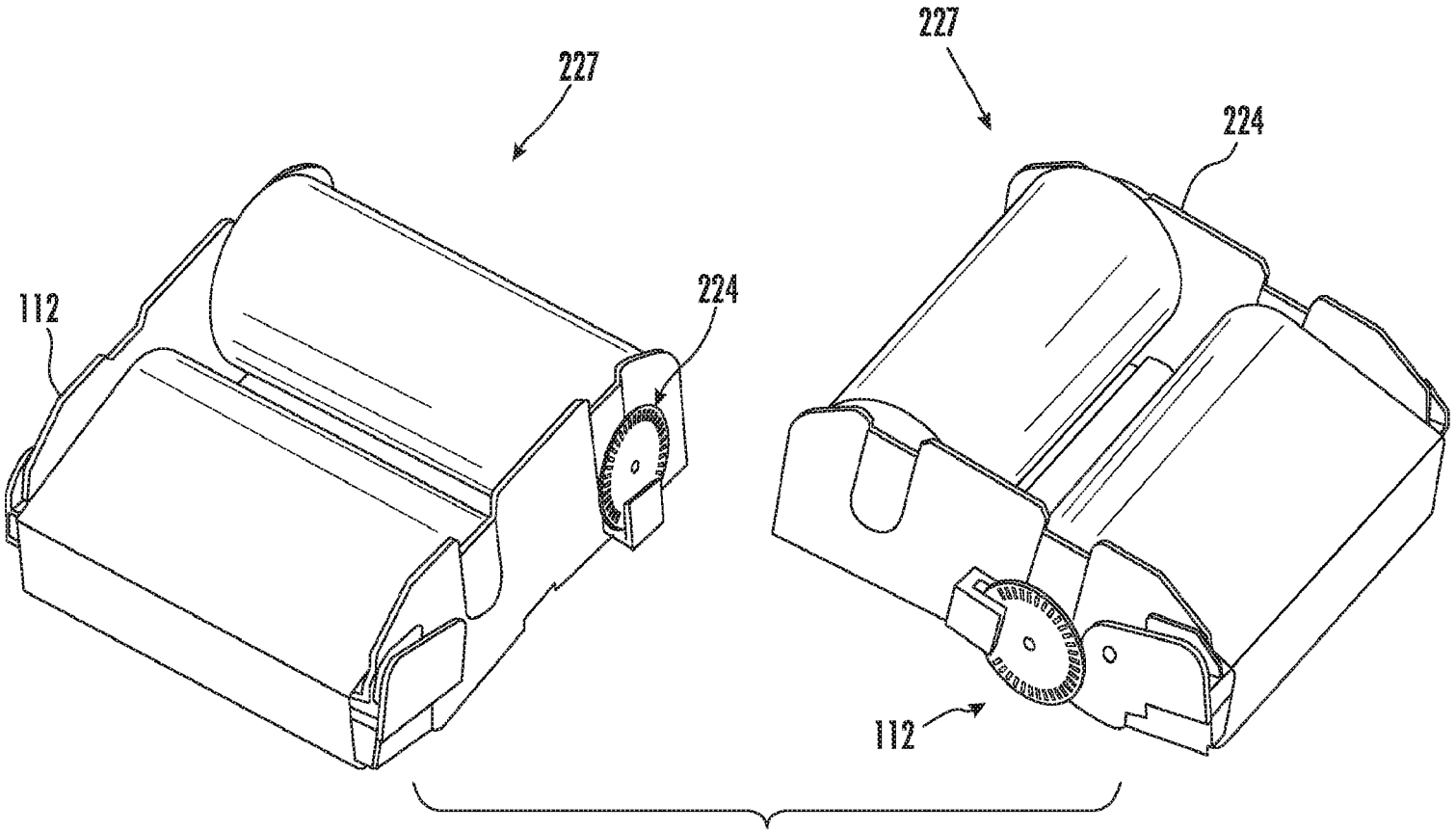
FIG. 2G illustrates an exemplary embodiment of two views of modular print engine that identifies the media encoder and ribbon encoder.
Figure 2H:
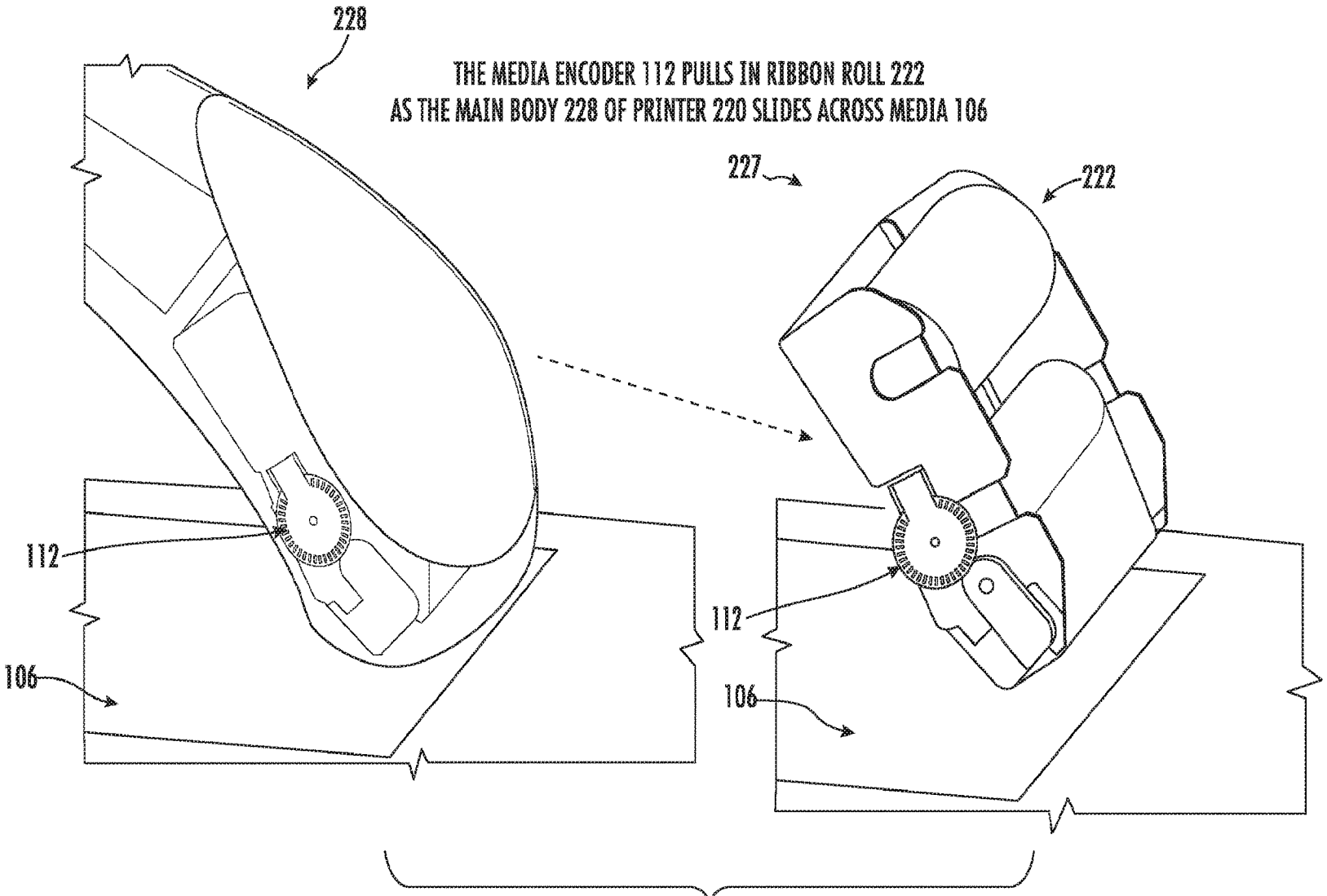
FIG. 2H illustrates an exemplary embodiment of a view of main body including media encoder, ribbon roll and media.
Figure 21:
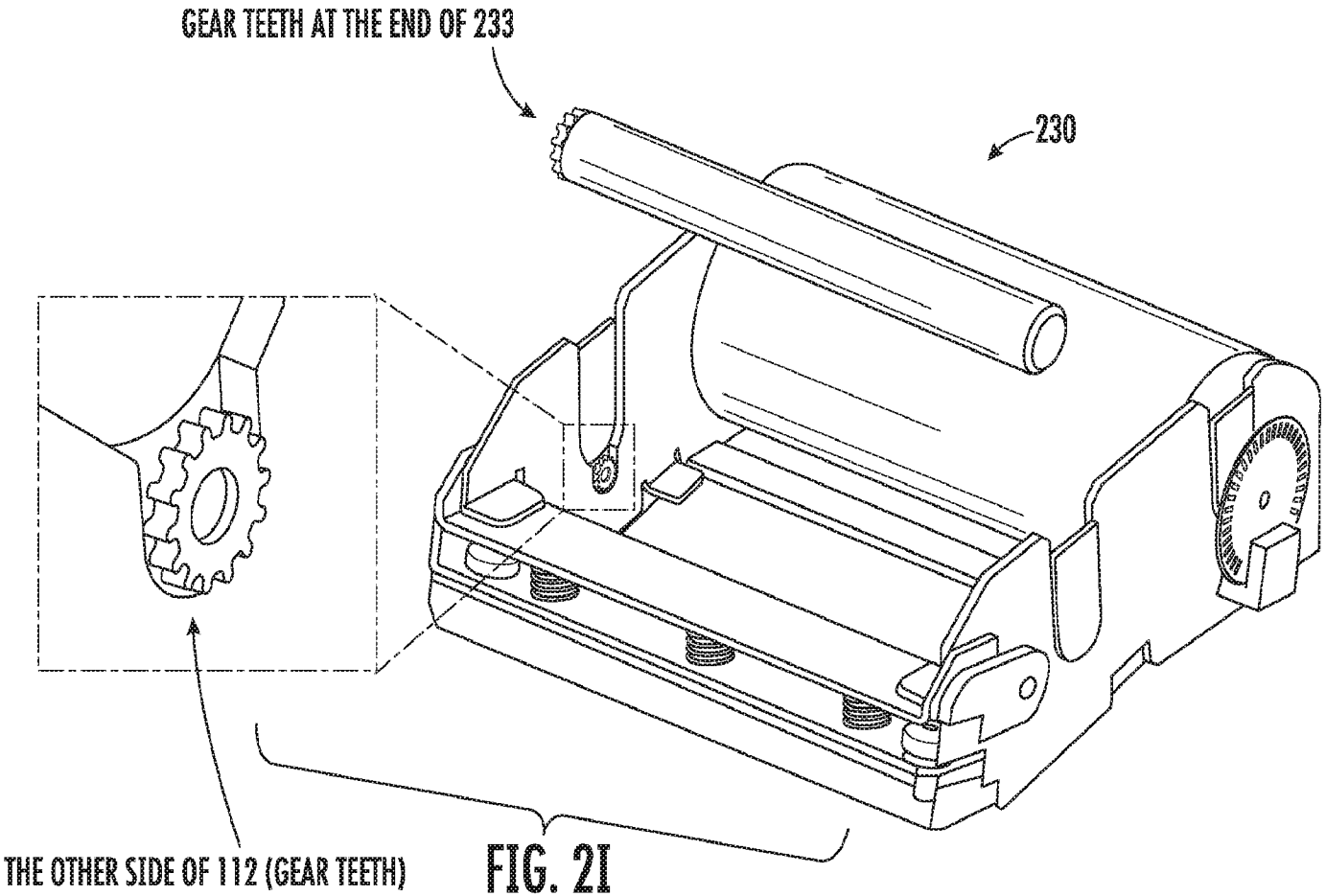
Figure 2J:
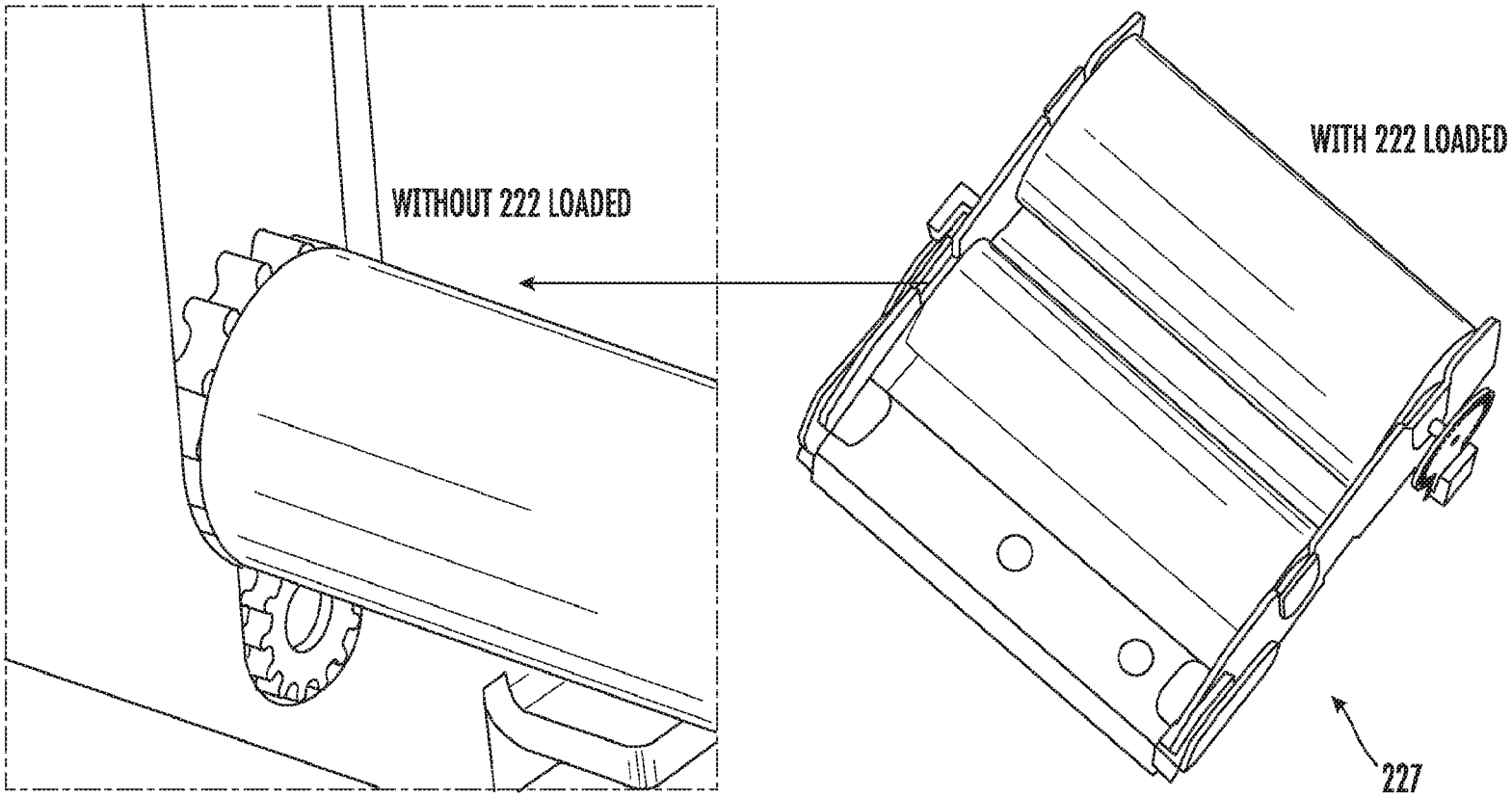
FIG. 2J illustrates an exemplary embodiment of a close-up view of ribbon roll and modular print engine.

The media encoder 112 pulls in loose ribbon as the printer slides across the media 106. In other words, the media encoder pulls ribbon pass a burn line as the printer slides across the media This action is illustrated in FIG. 2G and FIG. 2H. FIG. 2G illustrates an exemplary embodiment of two views of modular print engine 227 that identifies the media encoder 112 and ribbon encoder 224. FIG. 2H illustrates an exemplary embodiment of a view of main body 228 including media encoder 112 and media 106. FIG. 2H also illustrates an exemplary embodiment of another view of modular print engine 227 including ribbon roll 222, media encoder 112 and media 106. The media encoder 112 pulls in ribbon roll 222 as the main body 228 (printer) slides across the media 106. FIG. 2I and FIG. 2J illustrate the action to pull in loose ribbon as the printer slides across the media 106. FIG. 2I illustrates an exemplary embodiment of modular print engine assembly 230 including ribbon rewind shaft 233 comprising gear teeth at one end of the ribbon rewind shaft 233. Also illustrated are the gear teeth on the other side of the media encoder 112. FIG. 2J illustrates an exemplary embodiment of a close-up view of ribbon roll 222 that is not load in modular print engine assembly 240 (not shown) and ribbon roll 222 loaded in modular print engine 227. The media encoder 112 pulls in loose ribbon as the printer slides across the media 106 utilizing the gear structure illustrated in FIG. 2I and FIG. 2J.

Figure 2K:
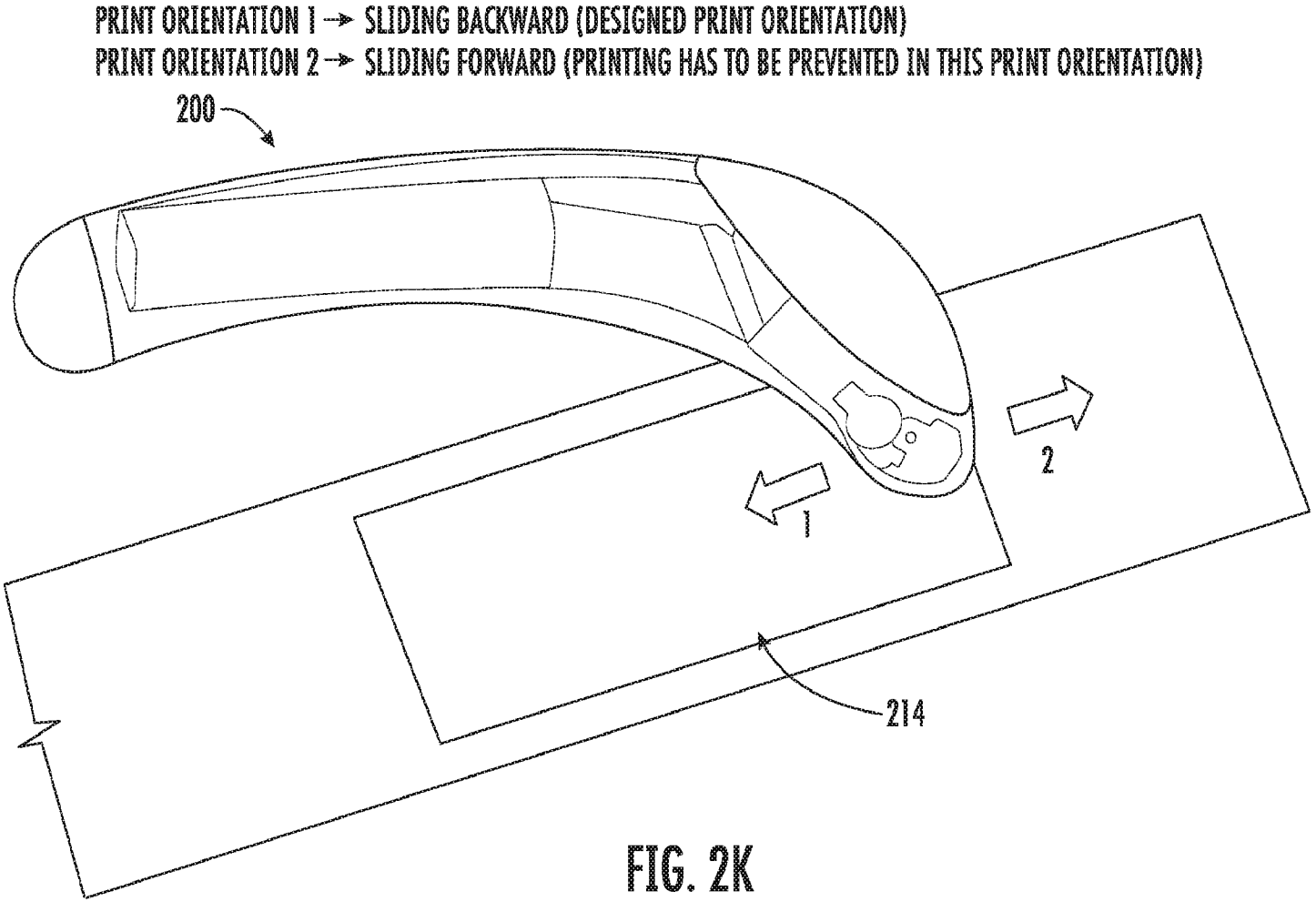
FIG. 2K illustrates an exemplary embodiment of printer sliding relative to media with two orientations.

FIG. 2K illustrates an exemplary embodiment of printer 200 sliding relative to media 214 with two orientations. With print orientation 1, the printer 200 is sliding backward relative to media 214. Print orientation 1 is the designed print orientation mode. With print orientation 2, the printer 200 is sliding forward relative to the media 214. Printing must be prevented with print orientation 2.

Figure 2L:
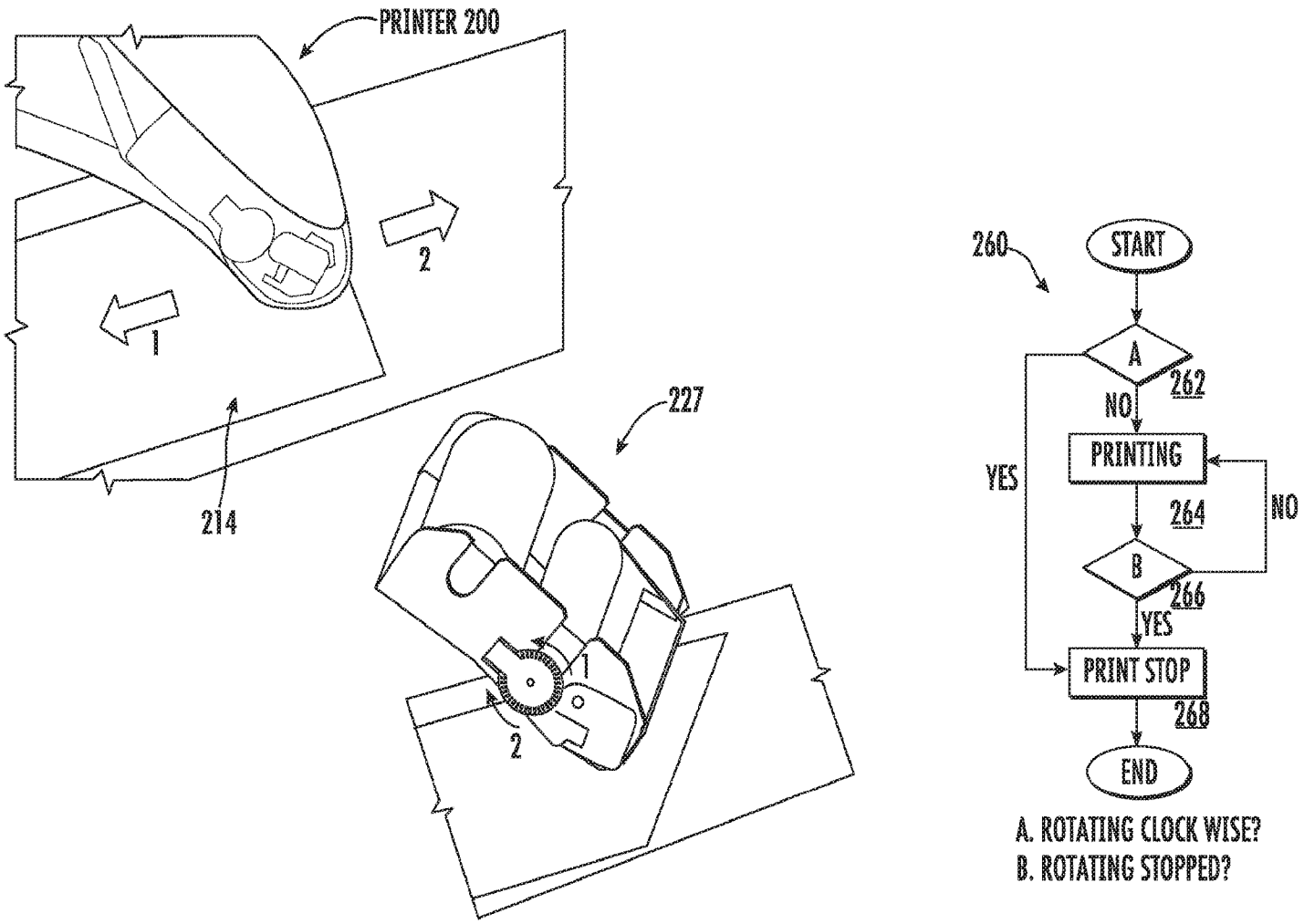
FIG. 2L illustrates an exemplary embodiment of the media encoder generating the signal based on a rotation in the media encoder caused by the printer sliding across the media.

Detection control may be utilized to prevent an incorrect orientation for printing. When firmware detects encoder rotation in the wrong direction, printing may stop. FIG. 2L illustrates an exemplary embodiment of the media encoder 112 generating the signal based on a rotation in the media encoder 112 caused by the printer 200 sliding across the media 106. With print orientation 1, media encoder 112 rotates counter clockwise. In print orientation 2, media encoder 112 rotates clockwise. FIG. 2L also includes a flowchart 260 describing the method for initiating and stopping printing. The method includes the following steps:

Does the encoder rotate clockwise? (A) (step 262)

If yes, stop printing. (step 268)

If no, initiate printing. (step 264)

Is the rotating stop? (B) (step 266)

If no, continue printing at step 264.

If yes, stop printing at step 268.

As used herein, media 106 and media 214 may be considered equivalent.

Figure 3:
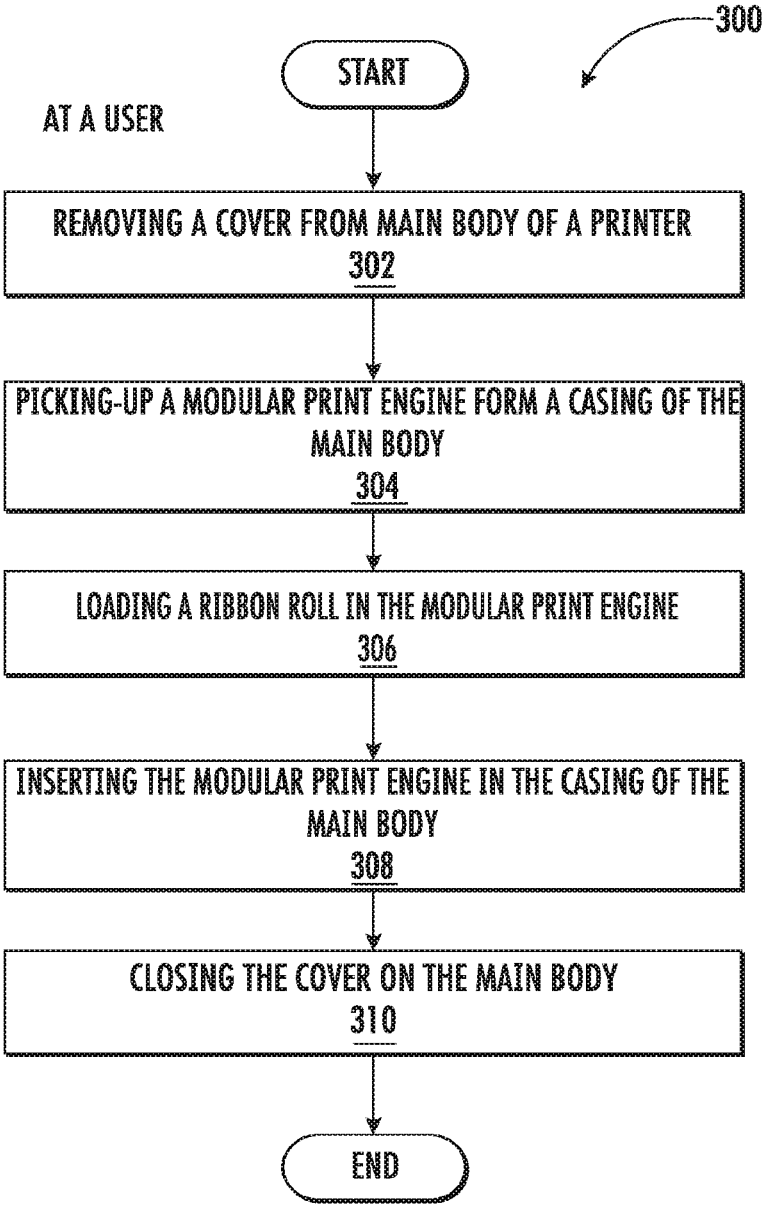
FIG. 3 illustrates an exemplary flowchart for a process to access the print head of a printer.

FIG. 3 illustrates an exemplary flowchart for a process 300 to access the print head of a printer. The process 300 comprises the following steps by a user:

Removing a cover from the main body of a printer. (step 302)

Picking-up the modular print engine from a casing of the main body. (step 304)

Loading a ribbon roll in the modular print engine (step 306)

Inserting the modular print engine in the casing of the main body (step 308)

Closing the cover on the main body. (step 310)

Loading the ribbon roll in the modular print engine comprises installing a new ribbon on a ribbon supply shaft, and removing an old ribbon from a ribbon rewind shaft. Closing the cover allows a print operation to begin.

Figure 4:
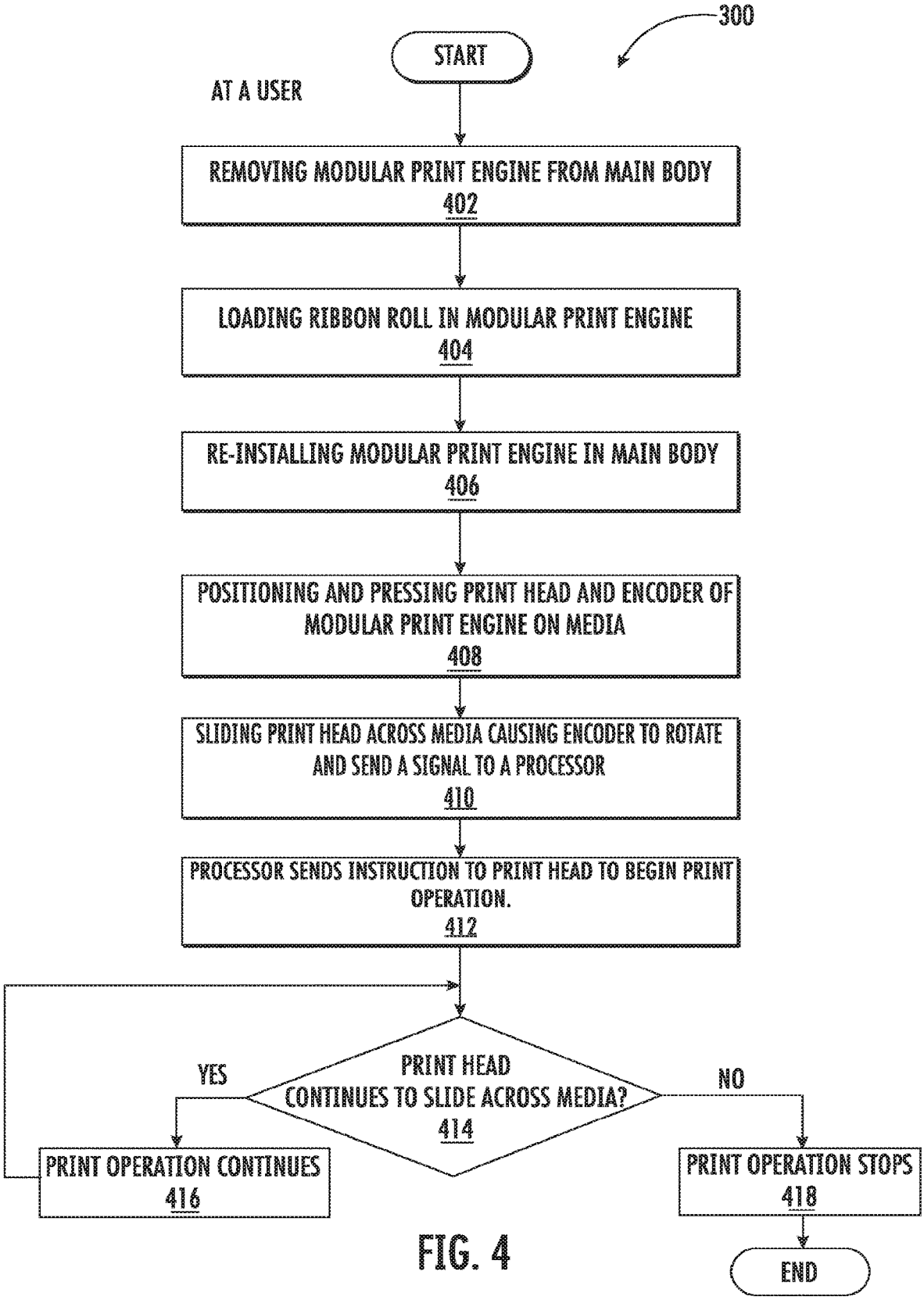
FIG. 4 illustrates an exemplary flowchart for a process to print with a printer.

FIG. 4 illustrates an exemplary flowchart for a process 400 to print with a printer. The process 400 comprises the following steps by a user:

Removing a modular print engine from a main body of a printer. (step 402)

Loading a ribbon roll in the modular print engine. (step 404)

Re-installing the modular print engine in the main body of the printer. (step 406)

Positioning and pressing a print head and an encoder of the modular print engine on a media located on a horizontal surface. (step 408)

Sliding the print head across the media causing the encoder to rotate and send a signal to a processor of the printer. (step 410)

The processor sends an instruction to the print head to begin a print operation. (step 412)

Does the print head continue to slide across the media? (step 414)

If the user continues to slide the print head across the media, the print head continues the print operation. (step 416)

If the user does not continue to slide the print head across the media, the processor sends an instruction to the print head to stop the print operation. (step 418)

To supplement the present disclosure, this application incorporates entirely by reference the following commonly assigned patents, patent application publications, and patent applications:

U.S. Pat. Nos. 6,832,725; 7,128,266; 7,159,783; 7,413,127; 7,726,575; 8,294,969; 8,317,105; 8,322,622; 8,366,005; 8,371,507; 8,376,233; 8,381,979; 8,390,909; 8,408,464; 8,408,468; 8,408,469; 8,424,768; 8,448,863; 8,457,013; 8,459,557; 8,469,272; 8,474,712; 8,479,992; 8,490,877; 8,517,271; 8,523,076; 8,528,818; 8,544,737; 8,548,242; 8,548,420; 8,550,335; 8,550,354; 8,550,357; 8,556,174; 8,556,176; 8,556,177; 8,559,767; 8,599,957; 8,561,895; 8,561,903; 8,561,905; 8,565,107; 8,571,307; 8,579,200; 8,583,924; 8,584,945; 8,587,595; 8,587,697; 8,588,869; 8,590,789; 8,596,539; 8,596,542; 8,596,543; 8,599,271; 8,599,957; 8,600,158; 8,600,167; 8,602,309; 8,608,053; 8,608,071; 8,611,309; 8,615,487; 8,616,454; 8,621,123; 8,622,303; 8,628,013; 8,628,015; 8,628,016; 8,629,926; 8,630,491; 8,635,309; 8,636,200; 8,636,212; 8,636,215; 8,636,224; 8,638,806; 8,640,958; 8,640,960; 8,643,717; 8,646,692; 8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630; 8,822,848; 8,824,692; 8,824,696; 8,842,849; 8,844,822; 8,844,823; 8,849,019; 8,851,383; 8,854,633; 8,866,963; 8,868,421; 8,868,519; 8,868,802; 8,868,803; 8,870,074; 8,879,639; 8,880,426; 8,881,983; 8,881,987; 8,903,172; 8,908,995; 8,910,870; 8,910,875; 8,914,290; 8,914,788; 8,915,439; 8,915,444; 8,916,789; 8,918,250; 8,918,564; 8,925,818; 8,939,374; 8,942,480; 8,944,313; 8,944,327; 8,944,332; 8,950,678; 8,967,468; 8,971,346; 8,976,030; 8,976,368; 8,978,981; 8,978,983; 8,978,984; 8,985,456; 8,985,457; 8,985,459; 8,985,461; 8,988,578; 8,988,590; 8,991,704; 8,996,194; 8,996,384; 9,002,641; 9,007,368; 9,010,641; 9,015,513; 9,016,576; 9,022,288; 9,030,964; 9,033,240; 9,033,242; 9,036,054; 9,037,344; 9,038,911; 9,038,915; 9,047,098; 9,047,359; 9,047,420; 9,047,525; 9,047,531; 9,053,055; 9,053,378; 9,053,380; 9,058,526; 9,064,165; 9,064,165; 9,064,167; 9,064,168; 9,064,254; 9,066,032; 9,070,032; 9,076,459; 9,079,423; 9,080,856; 9,082,023; 9,082,031; 9,084,032; 9,087,250; 9,092,681; 9,092,682; 9,092,683; 9,093,141; 9,098,763; 9,104,929; 9,104,934; 9,107,484; 9,111,159; 9,111,166; 9,135,483; 9,137,009; 9,141,839; 9,147,096; 9,148,474; 9,158,000; 9,158,340; 9,158,953; 9,159,059; 9,165,174; 9,171,543; 9,183,425; 9,189,669; 9,195,844; 9,202,458; 9,208,366; 9,208,367; 9,219,836; 9,224,024; 9,224,027; 9,230,140; 9,235,553; 9,239,950; 9,245,492; 9,248,640; 9,250,652; 9,250,712; 9,251,411; 9,258,033; 9,262,633; 9,262,660; 9,262,662; 9,269,036; 9,270,782; 9,274,812; 9,275,388; 9,277,668; 9,280,693; 9,286,496; 9,298,964; 9,301,427; 9,313,377; 9,317,037; 9,319,548; 9,342,723; 9,361,882; 9,365,381; 9,373,018; 9,375,945; 9,378,403; 9,383,848; 9,384,374; 9,390,304; 9,390,596; 9,411,386; 9,412,242; 9,418,269; 9,418,270; 9,465,967; 9,423,318; 9,424,454; 9,436,860; 9,443,123; 9,443,222; 9,454,689; 9,464,885; 9,465,967; 9,478,983; 9,481,186; 9,487,113; 9,488,986; 9,489,782; 9,490,540; 9,491,729; 9,497,092; 9,507,974; 9,519,814; 9,521,331; 9,530,038; 9,572,901; 9,558,386; 9,606,581; 9,646,189; 9,646,191; 9,652,648; 9,652,653; 9,656,487; 9,659,198; 9,680,282; 9,697,401; 9,701,140;

U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;

U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;

U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A method of loading a ribbon roll in a modular print engine that includes a print head, comprising the steps of:

removing, by a user, the modular print engine from a main body of a printer;

loading, by the user, the ribbon roll into the modular print engine;

re-installing, by the user, the modular print engine in the main body of the printer positioning and pressing, by the user, the print head and a media encoder of the modular print engine on a media located on a horizontal surface; and sliding, by the user, the print head across the media, causing the media encoder to sense a movement of the media relative to the print head and send a signal to a processor of the printer, wherein the processor sends an instruction to the print head to begin a print operation.

2. The method according to claim 1, comprising, if the user continues to slide the print head across the media, the print head continues the print operation.

3. The method according to claim 1, comprising, if the user does not continue to slide the print head across the media, the processor sends another instruction to the print head to stop the print operation.

4. The method according to claim 1, wherein the user slides the print head across the media by holding a handle portion of the main body of the printer.

5. The method according to claim 1, wherein removing the modular print engine from the main body of the printer comprises the user removing a cover from the modular print engine and removing the modular print engine from a casing of the main body of the printer.

6. The method according to claim 1, wherein, when the print head presses against the media, a burn line of the print head presses ribbon against the media.

7. The method according to claim 1, wherein the media encoder pulls ribbon past a burn line as the printer slides across the media.

8. The method according to claim 1, wherein, the media encoder generates the signal based on a rotation in the media encoder caused by the printer sliding across the media.

9. The method according to claim 1, wherein, based on a direction of rotation of the media encoder, the modular print engine either stops printing, or continues printing.

10. A method of loading a ribbon roll in a modular print engine that includes a print head, comprising the steps of:

opening, by a user, a cover from a main body of a printer;

removing, by the user, the modular print engine from a casing of the main body;

loading, by the user, the ribbon roll in the modular print engine;

inserting, by the user, the modular print engine in the casing of the main body; and closing, by the user, the cover on the main body.

11. The method according to claim 10, wherein loading the ribbon roll in the modular print engine comprises installing a new ribbon on a ribbon supply shaft and removing an old ribbon from a ribbon rewind shaft.

12. The method according to claim 10, wherein the cover portion of the main body allows the modular print engine to be secured within the main body.

13. A printer for printing on a stationary media with a main body comprising:

a modular print engine assembly comprising:

a. a modular print head configured to print on the stationary media;

b. a printed circuit board (PCB) comprising a processor;

c. a media encoder configured to determine the movement of the modular print head relative to the stationary media, wherein the media encoder sends a signal to the processor with an instruction to start a print operation;

d. a ribbon supply shaft, the ribbon supply assembly being rotatable about an axis; and e. a ribbon rewind shaft;

a removeable cover to protect and secure the modular print engine assembly;

a handle portion that facilitates the movement between the modular print engine assembly and the stationary media; and a battery to supply power to the printer.

14. The printer according to claim 13, wherein, the media encoder generates the signal based on a rotation in the media encoder caused by the printer sliding across the stationary media.

15. The printer according to claim 13, wherein, based on a direction of rotation of the media encoder, the modular print engine assembly either stops printing, or continues printing.

16. The method according to claim 1, wherein the print head is removable from the modular print engine.

17. The method according to claim 11, wherein a ribbon encoder determines if the modular print engine is depleted of ribbon.

18. The method according to claim 10, wherein closing the cover allows start of print operation in response to pressing against the media, a burn line of the print head presses the ribbon against the media.

19. The printer according to claim 13, comprising a fine needle opening located at one end of the printer, wherein when an adapter plug is inserted in the fine needle opening, silicon rubber of the adapter plug conforms to a shape of the adapter plug and creates a seamless water proofing seal between the adapter plug and the printer.

20. The printer according to claim 13, wherein the modular print head is removable from the modular print engine assembly.

* * * * *